US007697708B2

(12) United States Patent
Akino

(10) Patent No.: US 7,697,708 B2
(45) Date of Patent: Apr. 13, 2010

(54) CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1182 days.

(21) Appl. No.: 11/280,229

(22) Filed: Nov. 17, 2005

(65) Prior Publication Data

US 2006/0110000 A1 May 25, 2006

(30) Foreign Application Priority Data

Nov. 19, 2004 (JP) ..... 2004-335317

(51) Int. Cl.
*H04R 9/08* (2006.01)
*H04R 25/00* (2006.01)
*H01R 9/05* (2006.01)

(52) U.S. Cl. ..... 381/369; 381/189; 381/174; 439/585; 439/578

(58) Field of Classification Search ..... 381/355
See application file for complete search history.

(56) References Cited

U.S. PATENT DOCUMENTS 5,183,411 A * 2/1993 Yu ..... 439/578
5,501,615 A * 3/1996 Inaba et al. ..... 439/578
6,116,945 A * 9/2000 Davis et al. ..... 439/462
6,200,162 B1 * 3/2001 Aoyama et al. ..... 439/578
6,411,709 B1 * 6/2002 Lucey ..... 379/430
6,643,380 B2 * 11/2003 Rodemer ..... 381/369
7,006,647 B1 * 2/2006 Wuersch ..... 381/324
2004/0129439 A1 * 7/2004 Tsutsui et al. ..... 174/36

FOREIGN PATENT DOCUMENTS

GB 2230151 A * 10/1990

* cited by examiner

*Primary Examiner*—Brian Ensey
*Assistant Examiner*—Sunita Joshi
(74) *Attorney, Agent, or Firm*—Manabu Kanesaka

(57) ABSTRACT

It provides a condenser microphone such as a tiepin type including a small microphone unit, which is capable of effectively suppressing noise generation due to an electromagnetic wave. It covers the entirety from a microphone unit 12 to a connecting cable 22 with an integrally formed cover member 32 and connects the cover member 32 to a shielded wire 25 so as to electromagnetically shield the entirety.

5 Claims, 2 Drawing Sheets

CONDENSER MICROPHONE

CROSS-REFERENCE TO RELATED APPLICATION

The present application is based on, and claims priority of, Japanese Patent Application NO. JP2004-335317, filed Nov. 19, 2004, the disclosure of which is hereby incorporated by reference herein in its entirety.

TECHNICAL FIELD

The present invention relates to a small condenser microphone, and in particular, to the condenser microphone connected to be capable of effectively suppressing noise generation due to an electromagnetic wave.

BACKGROUND ART

As shown in Patent Document 1 (Japanese Utility Model Registration No. 3027420) for instance, a connection between a microphone unit and a microphone cord of a condenser microphone is normally made by electrically connecting two cores consisting of a signal wire and a power wire of a connecting cord to a predetermined position on an impedance converter side respectively and soldering a shielded wire on a predetermined ground side.

Tiepin-type and headset-type condenser microphones are required to be rather unnoticeable in use and lightweight, and so they are designed so that an outside diameter of the microphone unit becomes 5 mm or less for instance. In the case of such a small condenser microphone, the microphone unit contains a condenser portion and an impedance converter, and an inputted sound signal is connected to a power module separately placed via a dedicated connecting cable. The power module contains main circuits such as a low-cut circuit and an output circuit for driving the microphone therein. As for the connecting cable, a microphone cable consisting of a two-core shielded covered wire is used.

FIG. 2 is a relevant part enlarged view showing a conventional example of a coupling structure of this small microphone unit and the connecting cable. In this example, a connecting cable 2 uses a power wire 4 for supplying power to a microphone unit 1, a signal wire 5 for sending a sound signal outputted from the impedance converter not shown to the power module side and a shielded wire 6 for electrostatically shielding and grounding the power wire 4 and signal wire 5, which are covered by a sheath 3.

The connecting cable 2 has the power wire 4, signal wire 5 and shielded wire 6 projected on its one end 2*a* side electrically connected by soldering them to the predetermined positions on the microphone unit 1 side respectively. A joint between the microphone unit 1 and the connecting cable 2 is protected by covering and solidifying the portion between a back end side of the microphone unit 1 and the one end 2*a* side of the connecting cable 2 with an appropriate synthetic resin material 7 such as polypropylene to couple them integrally for protection.

In the case of the small condenser microphone 1 shown in FIG. 2, however, the sound signal in the connecting cable 2 is apt to be transmitted in an unbalanced state and so it is weak against noise from outside unlike a large condenser microphone. Therefore, there is a problem that if a strong electromagnetic wave is applied to the connecting cable 2 from a cellular phone for instance, the electromagnetic wave goes inside the microphone unit 1 and the power module so as to be detected by a semiconductor and generate the noise.

In the case of the coupling structure shown in FIG. 2 in particular, the power wire 4 and signal wire 5 are not covered by the shielded wire 6 but are connected to the microphone unit 1 side in an exposed state. Besides, the joint is covered by the synthetic resin material 7 having no shielding effect so that, if the electromagnetic wave goes into the power wire 4 and signal wire 5, there is a possibility that a high-frequency current may go into the shielded wire 6 and induce the noise.

SUMMARY OF THE INVENTION

Thus, the present invention has been made to solve the above-mentioned problem, and an object thereof is to provide a condenser microphone such as a tiepin type including a small microphone unit, which is capable of effectively suppressing noise generation due to an electromagnetic wave.

To achieve the above-mentioned object, the present invention is a condenser microphone comprising: a microphone unit including a condenser portion and an impedance converter; a connecting cable connected to the microphone unit; and a metallic cover member for supporting a part of the microphone unit and covering a joint between the microphone unit and the connecting cable, wherein: the connecting cable has a shielded wire covering a periphery of cores connected to the microphone unit and a sheath portion covering the cores and the shielded wire; and the shielded wire is partially folded back on the sheath portion of the connecting cable and fixed in contact with the cover member.

According to this, it is possible, by covering the entire area between the microphone unit and the connecting cable with the shielded cover member, to exert an excellent shielding effect and securely prevent penetration of a high-frequency current generated due to the electromagnetic wave so as to block noise generation.

As a preferred embodiment, it is desirable to provide projections for increasing a contact pressure on a supporting surface of the cover member for supporting the microphone unit.

According to this, it is possible, by providing the projections on an internal surface of the cover member facing the microphone unit, to increase the contact pressure of the cover member against the microphone unit so as to further ensure a mutual conducting state.

DETAILED DESCRIPTION

Figure 1:
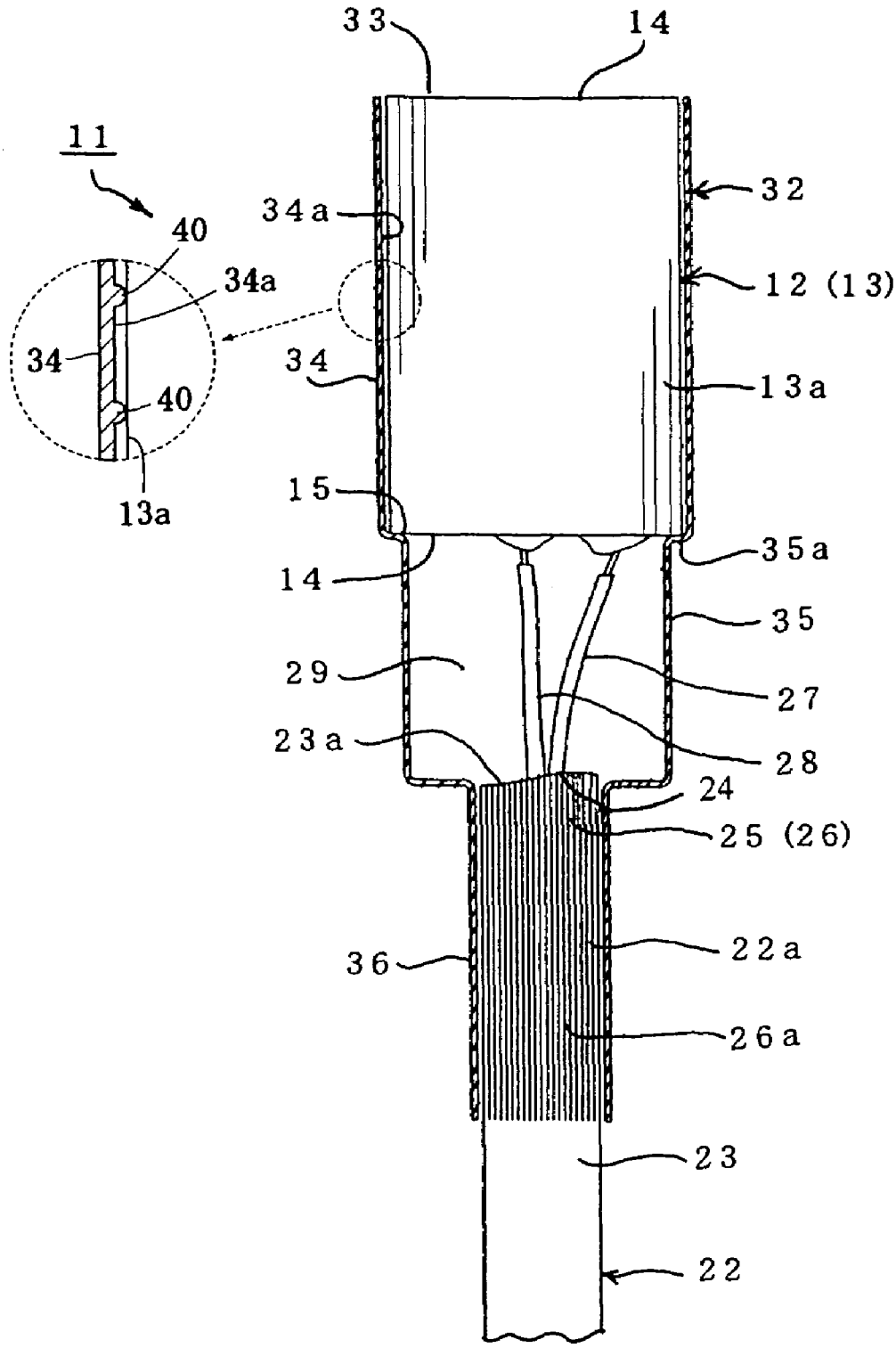
FIG. 1 is a relevant part enlarged view showing an example of a coupling structure between a microphone unit and a connecting cable according to an embodiment of the present invention.
Figure 2:
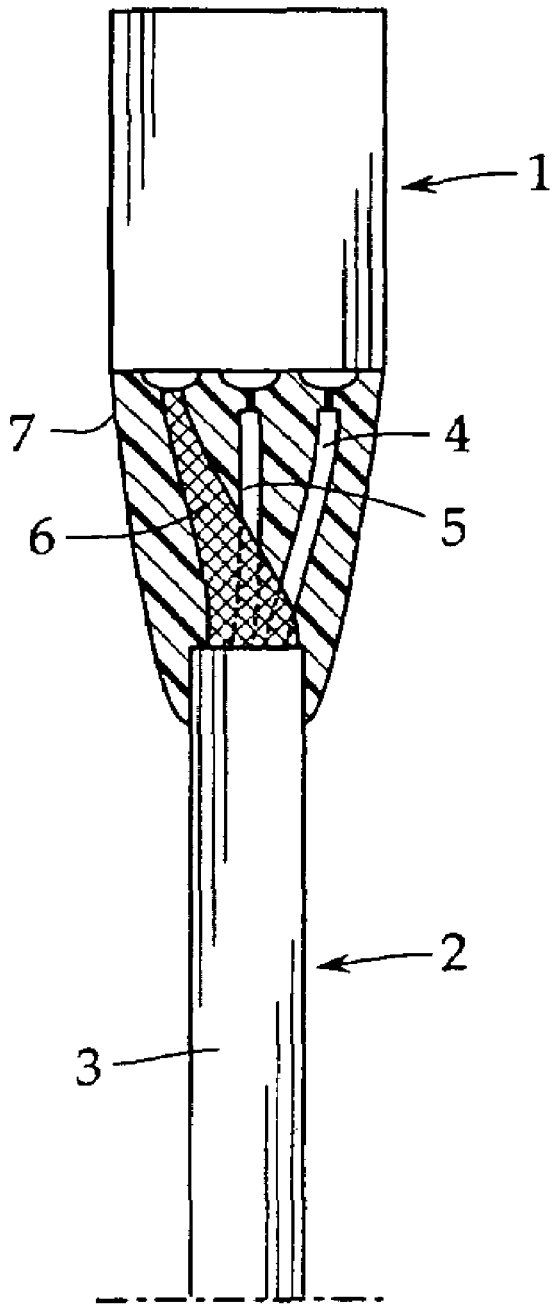
FIG. 2 PRIOR ART
FIG. 2 is a relevant part enlarged view showing a conventional example of the coupling structure of the connecting cable to a small microphone unit.

FIG. 1 is a relevant part enlarged view showing an example of a coupling structure between a microphone unit and a connecting cable of a condenser microphone according to the present invention. The present invention is not limited thereto.

As shown in FIG. 1, a condenser microphone 11 comprises a microphone unit 12 consisting of a cylindrical metallic case 13, a connecting cable 22 having its one end 22*a* electrically connected to the microphone unit 12, and a cover member 32 for covering a joint between the microphone unit 12 and the connecting cable 22 by having a front acoustic terminal opening surface 14 side opened.

The microphone unit 12 comprises a condenser portion having a diaphragm and a back plate placed face-to-face via a spacer for instance and an impedance converter for converting an electrical signal of high impedance obtained from the condenser portion to low impedance (neither is shown). The microphone unit 12 has the cylindrical metallic case 13 consisting of a conductive metallic material such as aluminum, and has the front acoustic terminal opening surface 14 formed on its apical surface.

The connecting cable 22 comprises a power wire 27 for supplying power to the microphone unit 12 side, a signal wire 28 as a signal wire for sending a sound signal outputted from the impedance converter to a power module side and a shielded wire 25 formed to cover a periphery of the power wire 27 and signal wire 28, which are covered by a sheath 23. The shielded wire 25 is partially folded back by a required length from an end face 24 side of the sheath 23, and is formed as a shielding layer 26 on a peripheral surface 23*a* thereof.

The power wire 27 and signal wire 28 drawn forth from the one end 22*a* side of the connecting cable 22 are soldered to predetermined positions on the microphone unit 12 respectively.

The cover member 32 consists of a conductive metal plate such as aluminum which is stamped, and integrally comprises a first cover portion 34 for housing the microphone unit 12, a second cover portion 35 for covering over a surrounding space 29 from a back end (lower end in FIG. 1) of the microphone unit 12 to the end of the connecting cable 22, and a third cover portion 36 for covering over the shielding layer 26 from the end of the connecting cable 22.

The first cover portion 34 has an opening 33 for inserting the microphone unit 12 provided at its end (upper end in FIG. 1). The second cover portion 35 is formed with a little smaller diameter than the first cover portion 34. The third cover portion 36 has a diameter even smaller than the second cover portion 35, and has an inside diameter slightly smaller than an outside diameter of the connecting cable 22 so as to put its inner face forcibly in contact with the shielding layer 26 of the connecting cable 22.

As shown in the partial enlarged view of FIG. 1, it is desirable to have projections 40 projected toward the microphone unit 12 on an internal surface 34*a* of the first cover portion 34 facing a peripheral surface 13*a* of the microphone unit 12. According to this, it is possible to increase a contact pressure of mutual supporting surfaces between the peripheral surface 13*a* of the metallic case 13 of the microphone unit 12 and the cover member 32. In this example, the multiple projections 40 are projected hemispherically, where a point-like form or a linear form is suitable used. It is desirable to have more than one projection 40 provided. The form and the number of the projections 40 can be set arbitrarily according to the specification.

The microphone unit 12 is supported as if propped up by having a bottom surface 15 and its margin 15*a* put in contact with a step portion 35*a* formed between the first cover portion 34 and the second cover portion 35.

The third cover portion 36 has at least a length to cover the shielding layer 26 formed on the one end 22*a* on the connecting cable 22 side. In this example, the third cover portion 36 is formed to have a smaller diameter than the connecting cable 22 in order to obtain secure conduction with the shielding layer 26. It is also possible, however, to form the third cover portion 36 with the same diameter as the second cover portion 35 side so as to caulk an area facing the shielding layer 26, reduce the diameter thereof and perform the conduction. It is also possible to provide the above-mentioned projections on the internal surface of the third cover portion 36 so as to increase contact area.

According to this, even if the power wire 27 and signal wire 28 are connected to the microphone unit 12 side in a state of being exposed from the shielded wire 25, it is also possible to shield the surroundings securely by covering over the entirety from the microphone unit 12 to the connecting cable 22 with the cover member 32 and conducting the cover member 32 to the shielding layer 26.

Therefore, even in the case of using a device generating an electromagnetic wave such as a cellular phone in proximity to the condenser microphone 11, it is possible to interrupt the electromagnetic wave generated from the cellular phone and effectively prevent it from going inside the cover member 32 so as to suppress noise generation.

Furthermore, in the case where the projections are provided on the internal surface of the cover member facing the microphone unit, it is possible to increase the contact pressure of the cover member against the microphone unit side so as to further ensure a mutual conducting state and thereby further enhance a shielding effect.

The above described the present invention based on the examples shown in the drawings, and a concrete configuration thereof is not limited thereto. For instance, as for the cover member, its concrete appearance and form may be adopted as appropriate only if capable of securely covering the entire area from the microphone unit to the shielding layer located on the one end side of the connecting cable in a conductive state. As for the connecting cable 22, this example shows the one having a two-wire structure. However, it may have either the structure of one wire or the structure of two or more wires. Furthermore, as for the conduction between the shielding layer 26 and the third cover portion 36, it is also possible, without pressure-welding them by using press fitting, caulking means or the like, to place them as if wrapping them around more softly with a conductive resin or the like.

The invention claimed is:

1. A condenser microphone comprising:

a microphone unit including a condenser portion and an impedance converter;

a connecting cable having cores connected to the microphone unit, a shielded wire covering the cores, and a sheath portion covering the cores and the shielded wire, the shielded wire being partially folded back on an outer periphery of the sheath portion; and a metallic cover member having a first cover portion for housing the microphone unit, a second cover portion for covering a space extending from the microphone unit to an end of the sheath of the connecting cable, and a third cover portion covering the folded back shielded wire on the sheath portion and electrically and mechanically fixed thereto, said first, second and third cover portions being integrally formed together.

2. The condenser microphone according to claim 1, wherein projections for increasing a contact pressure are provided on an inner surface of the first cover member for supporting the microphone unit.

3. A condenser microphone comprising:

a microphone unit including a condenser portion and an impedance converter;

a connecting cable having cores connected to the microphone unit, a shielded wire covering the cores, and a sheath portion covering the cores and the shielded wire, the shielded wire being partially folded back on an outer periphery of the sheath portion; and a metallic cover member having a first cover portion for housing the microphone unit, a second cover portion for covering a space extending from the microphone unit to an end of the sheath of the connecting cable, and a third cover portion covering the folded back shielded wire on the sheath portion and electrically and mechanically fixed thereto, said first, second and third cover portions being integrally formed together, wherein projections for increasing a contact pressure are provided on an inner surface of the first cover member for supporting the microphone unit, wherein said metallic cover member further includes a step portion formed between the first and second cover members to support the microphone unit at the step portion.

4. The condenser microphone according to claim 3, wherein said second cover portion is cylindrical and entirely surrounds the space.

5. The condenser microphone according to claim 1, wherein said cover member entirely covers the microphone unit, the space and the folded back shielded wire, and continuously extends from the microphone unit to the folded back shielded wire.

* * * * *